United States Patent [19]

Tokuno et al.

[11] Patent Number: 4,577,746

[45] Date of Patent: Mar. 25, 1986.

[54] CONTROL SYSTEM FOR BLANK PRESSER

[75] Inventors: Masateru Tokuno, Hyogo; Tetsuya Sawada, Kyoto; Yasuharu Mori, Hyogo, all of Japan

[73] Assignee: Rengo Co., Ltd., Osaka, Japan

[21] Appl. No.: 712,475

[22] Filed: Mar. 18, 1985

Related U.S. Application Data

[63] Continuation of Ser. No. 399,134, Jul. 16, 1982, abandoned.

[30] Foreign Application Priority Data

Nov. 20, 1981 [JP] Japan ..... 56-114543
Jul. 2, 1982 [JP] Japan ..... 57-115905

[51] Int. Cl.[4] ..... B65G 47/31

[52] U.S. Cl. ..... 198/462; 198/575; 271/202

[58] Field of Search ..... 198/462, 571, 575, 577; 271/182, 176, 202, 203, 180

[56] References Cited

U.S. PATENT DOCUMENTS 2,971,630 2/1961 Michaels ..... 198/571 X
3,507,489 4/1970 Wilshin et al. ..... 271/182

FOREIGN PATENT DOCUMENTS 1436590 5/1969 Fed. Rep. of Germany .
2922959 1/1980 Fed. Rep. of Germany .
3037514 4/1981 Fed. Rep. of Germany .

*Primary Examiner*—Joseph E. Valenza
*Assistant Examiner*—Dennis Williamson
*Attorney, Agent, or Firm*—Wenderoth, Lind & Ponack

[57] ABSTRACT

A control system for a blank presser used to touch down blanks fed from a conveyor controls the blank presser so as to hold down each of the blanks at the proper time, so as to thereby prevent them from scattering or jamming up. The control system can control the blank presser automatically even if the speed or length of the blanks changes.

2 Claims, 4 Drawing Figures

CONTROL SYSTEM FOR BLANK PRESSER

BACKGROUND OF THE INVENTION

This application is a continuation of now abandoned application Ser. No. 399,134, filed July 16, 1982.

The present invention relates to a control system for a blank presser used to timely and lightly touch down blanks fed from a conveyor, thereby preventing them from scattering or jamming up. The control system is adapted to adjust the movement of the blank presser automatically in response to any change in the blank feed speed and the blank length.

In the production line of corrugated fiberboard, a web of corrugated fiberboard is cut into blanks of a predetermined length by a rotary cutter, said blanks being fed by a first conveyor running at a slightly higher speed than the web speed and then further fed shingled on a second conveyor running at a slightly lower speed than the first conveyor. At the supply end of the second conveyor, a blank presser is usually provided. The first conveyor serves to prevent the jamming between the rear end of the last blank just cut and the front end of the web and/or the cutting blade of the rotary cutter. The second conveyor serves to bring the blanks fed one after another into a shingled state. Also, the blank presser serves to press or hold down the blanks fed at a high speed, thereby preventing them from scattering or jamming up.

The best timing for the blank presser to hold the blank is at the instant the blank leaves the first conveyor or just before or just after that. If the timing were too late, the blanks would scatter and jam up, causing trouble. If the timing were too early so that the blank is held by the presser before it leaves the first conveyor, the blank would be rubbed by the first conveyor, interfere with the next blank or be bent between the first conveyor and the second one.

Also, the period at which the blank presser touches the blanks has to be changed each time the blank length or the blank feed speed is changed. Further, the length of the first conveyor has to be taken into consideration for optimum timing. Conventionally, the movement of the blank presser had to be watched and adjusted by hand each time the blank length or the blank speed changes.

SUMMARY OF THE INVENTION

An object of the present invention is to provide a control system for a blank presser which eliminates the need of watching and manual adjustment of the blank presser even in the presence of any change in the blank length or blank speed.

In accordance with the present invention, a control system for controlling a blank presser used to touch or hold down each of blanks fed one after another from a conveyor, sets a value (L) proportional to the length of the blanks fed from said conveyor and a value (l) proportional to the distance by which said blank presser moves in one cycle of its operation, and then generates a signal ($\phi_A$) proportional to the speed at which said blanks are fed and a signal ($\phi_B$) proportional to the speed of said blank presser, and then performs a computation expressed by $l/L \times \phi_A - \phi_B$; the system then combines an error voltage proportional to the result of the computation with a reference voltage proportional to said signal ($\phi_A$) multiplied by l/L, and then controls a drive for said blank presser by use of the combined voltage so that the blanks will be held down by said blank presser at a correct timing.

BRIEF DESCRIPTION OF THE DRAWINGS

Other features and advantages of the present invention will become apparent from the following description taken with reference to the accompanying drawings, in which.

DESCRIPTION OF THE PREFERRED EMBODIMENT

Figure 2:
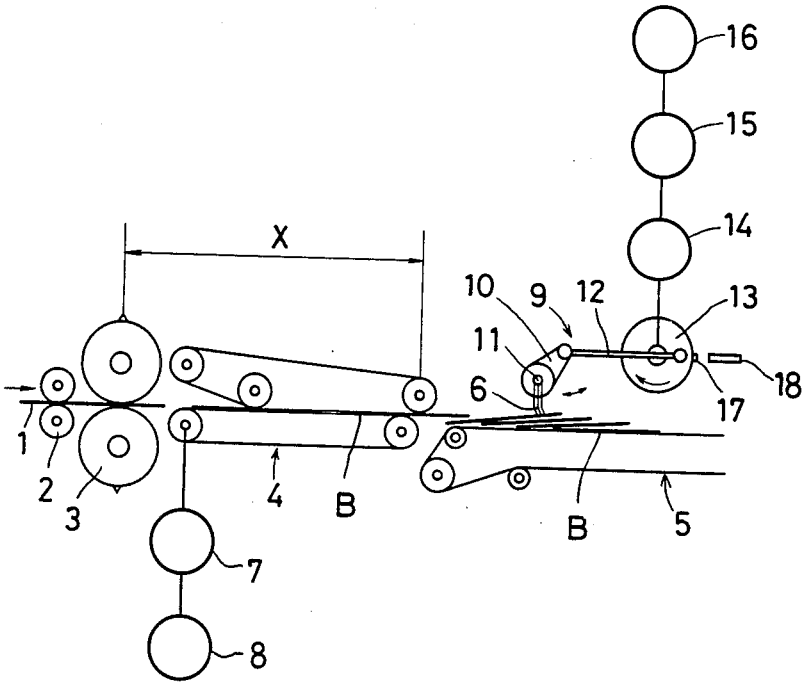
FIG. 2 is a similar view showing a blank presser used in the present invention.

Referring first to FIG. 2 showing a blank presser used in the present invention, a web 1 of corrugated fiberboard is fed by a pair of feed rolls 2 to a rotary cutter 3 where it is cut into blanks B of a predetermined length. The blanks are fed on a sandwich belt conveyor 4 to a belt conveyor 5 which feeds the blanks to the next station. The sandwich belt conveyor 4 has at least one pair of belts between which each blank is clamped to be fed. The speed of the sandwich belt conveyor 4 is set to be equal to or slightly higher than the speed of the web 1 to prevent trouble due to interference between the tip of the web 1 and the rear end of the last blank B. Also, the speed of the belt conveyor 5 is set to be lower than both that of the conveyor 4 and the web speed and the supply end of the belt conveyor 5 is below the discharge end of the conveyor 4 so that the blanks will be shingled on the belt of the conveyor 5 for feeding to the next station. In order to prevent the blanks (fed at a considerably high speed) from jamming up, a blank presser brush 6 is provided at the supply end of the conveyor 5 so as to touch or hold down each of the blanks just about when the blank has left the sandwich belt conveyor 4.

Figure 1:
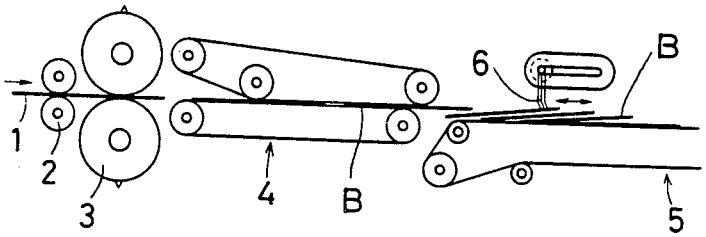
FIG.1 PRIOR ART
FIG. 1 is a view showing the conventional blank presser in use.

With the conventional blank presser, the brush 6 was mounted so as to be movable back and forth as shown in FIG. 1 by arrow. Conventionally, the position of the blank presser had to be manually adjusted back and forth according to the length of the blanks and the blank feed speed.

Referring again to FIG. 2, a blank presser generally designated by numeral 9 comprises a presser brush 6 fixedly mounted on an arm 10 through a mounting bar 11, said arm being coupled through a rod 12 to a crank disc 13. By this arrangement, the rotation of the crank disc is converted to a rocking motion of the presser brush 6. The blank presser 9 is disposed at such a position that the brush 6 can hold down all the blanks at a fixed position some distance away from their rear end even if the length of the blanks is minimum. The brush is adapted to touch each of the blanks at its fixed position while rocking in a vertical plane.

The sandwich belt conveyor 4 is driven by a first driving motor 7 to which is connected a first pulse generator 8 for generating pulses, the number of which is proportional to the revolutions of the motor 7. The crank disc 13 is driven by a second driving motor 14 to which are connected a tachometer generator 15 giving a signal proportional to the speed of the motor 14 and a second pulse generator 16 for generating pulses, the number of which is proportional to the revolutions of the motor 14.

In order to detect that each rocking motion of the brush 6 has been completed, a marker 17 is fixedly mounted on the crank disc 13 and a detector 18 is provided near the crank disc to detect the marker, giving a detection signal S. The detector 18 is adapted to give the detection signal when the presser brush 6 starts holding down the blank B.

Figure 3:
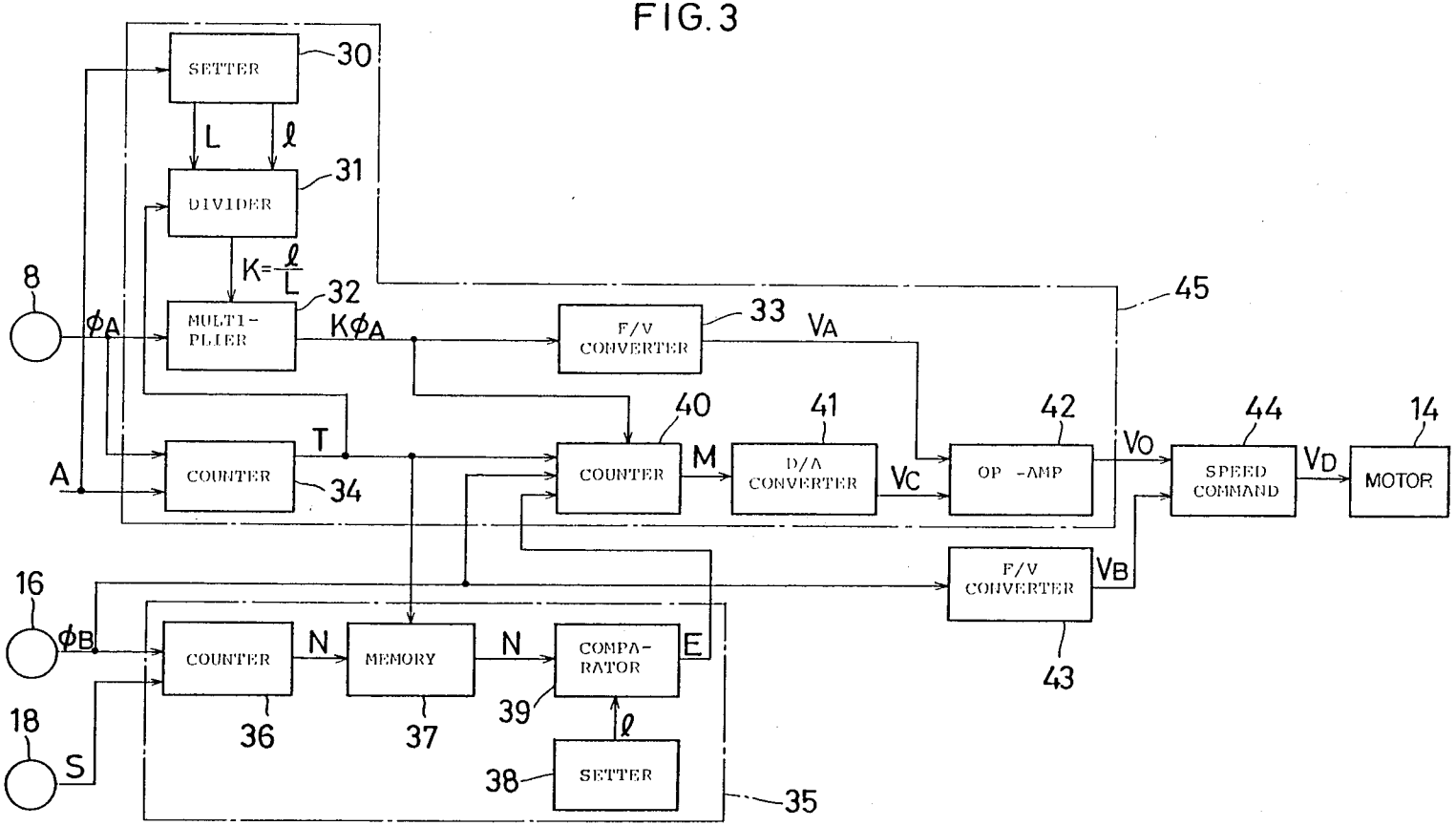
FIG. 3 is a block diagram of a control system according to the present invention.

Next, a control circuit for the blank presser embodying the present invention will be described with reference to FIG. 3.

Firstly, two values L and are set in a first setter 30. The values L and l are proportional to the length of the blanks B and the circumference of the crank disc 13, respectively. These values L and l are given to a divider 31 which divides the value l by L to obtain a coefficient K (=l/L).

A multiplier 32 multiplies the coefficient K by a pulse signal $\phi_A$ from the first pulse generator 8 which is proportional to the length for which the blank has been fed. The signal $K\phi_A$ from the multiplier 32 is put into a first frequency/voltage (F/V) converter 33 which converts the frequency of the signal $K\phi_A$ to a voltage, which is used as a reference voltage $V_A$ for the second motor 14.

A first counter 34 starts the counting of the pulse signal $\phi_A$ in response to an external signal A and gives a timing signal T when the count has reached a value X proportional to the distance between the web cutting point and the discharge end of the sandwich belt conveyor 4. The external signal A is a signal indicating that the blank has been supplied to the sandwich belt conveyor 4, e.g. a cutting complete signal given at the instant when the rotary cutter 3 has completed the cutting. The first counter 34 and the divider 31 will be described later in more detail.

A position compensation circuit 35 receives a pulse signal $\phi_B$ from the second pulse generator 16, the timing signal T and the detection signal S; the circuit then checks the position of the marker 17 each time the timing signal T is given, and gives a compensation value E proportional to the amount of deviation from the correct position of the crank disc 13. (It should be at such a position that the brush comes to the operative position just when the timing signal T is given.) The compensation value is set to be negative when the marker 17 is leading against the correct position and be positive when it is lagging.

In the position compensation circuit 35, a second counter 36 for counting the pulse signal $\phi_B$ from the second pulse generator 16 is reset and restarts the counting each time the detector 18 senses the marker 17 and gives a detection signal S. The count N in the second counter 36 is stored in the memory circuit 37 in response to the timing signal T. The value l, which is the same as the one set in the first setter 30, is set in a second setter 38 and given to a comparator 39, which compares the count N from the memory circuit 37 with the value l/2 and gives a value E ($E=-N$ when $N<l/2$ and $E=-N$ when $N\geqq l/2$.) The comparison of N with l/2 is done to check whether the marker 17 is at the correct position or is lagging or leading when the timing signal T is given. The count N may be compared with a value l/3 or any other suitable value. Because the control does not have to be so accurate, the position compensation circuit 35 may be adapted so that its output will be zero if the absolute value of the compensation value E is below a predetermined value.

A third counter 40 counts up the signal $K\phi_A$, from the multiplier 32 and counts down the pulse signal $\phi_B$ from the second pulse generator 16. It also reads the compensation value E from the position compensation circuit 35 in response to the timing signal T from the first counter 34 and gives the result of the computation $M=K\phi_A-\phi_B+E$, to a digital/analog converter 41 which converts the value M to an analog error voltage Vc. The error voltage Vc and the reference voltage $V_A$ are given to an operational amplifier 42 which combines them and gives a speed reference voltage Vo ($=V_A+Vc$) for the second motor 14.

A second F/V converter 43 converts the pulse signal $\phi_B$ from the second pulse generator 16 to a voltage $V_B$ proportional to its frequency. A speed command unit 44 compares the voltage $V_B$ fed back with the speed reference voltage Vo to check to see if the second motor 14 for the blank presser is operating at a speed corresponding to the reference voltage. If there is any difference therebetween, the speed command unit 44 will add it to, or subtract it from, the reference voltage Vo so that the motor will rotate just at Vo. If the voltage Vo is zero, the speed command unit 44 will stop the motor 14.

The blank presser is controlled so that the crank disc 13 makes one full turn each time one blank is fed from the sandwich belt conveyor 4.

In short, a computing means 45 including the setter 30, divider 31, multiplier 32, F/V converter 33, counter 34, counter 40, D/A converter 41 and operational amplifier 42 multiplies the pulse signal $\phi_A$ from the first pulse generator 8 by a coefficient K (equal to the circumference l of the crank disc 13 divided by the length L of blanks), counts up the product $K\phi_A$ and counts down the pulse signal $\phi_B$ from the second pulse generator, and combines the voltage Vc corresponding to the result of counting, $K\phi_A-\phi_B$ or $K\phi_A-\phi_B+E$ (E is the compensation value from the circuit 35) with the voltage $V_A$ corresponding to the product signal $K\phi_A$, and gives a voltage $V_A+Vc$.

Although in this embodiment the product signal $K\phi_A$ is first obtained and then the reference signal $V_A$ is obtained therefrom, $V_A$ may be obtained in any other way, e.g. by converting the pulse signal $\phi_A$ to a voltage and multiplying the voltage by the coefficient K.

Figure 4:
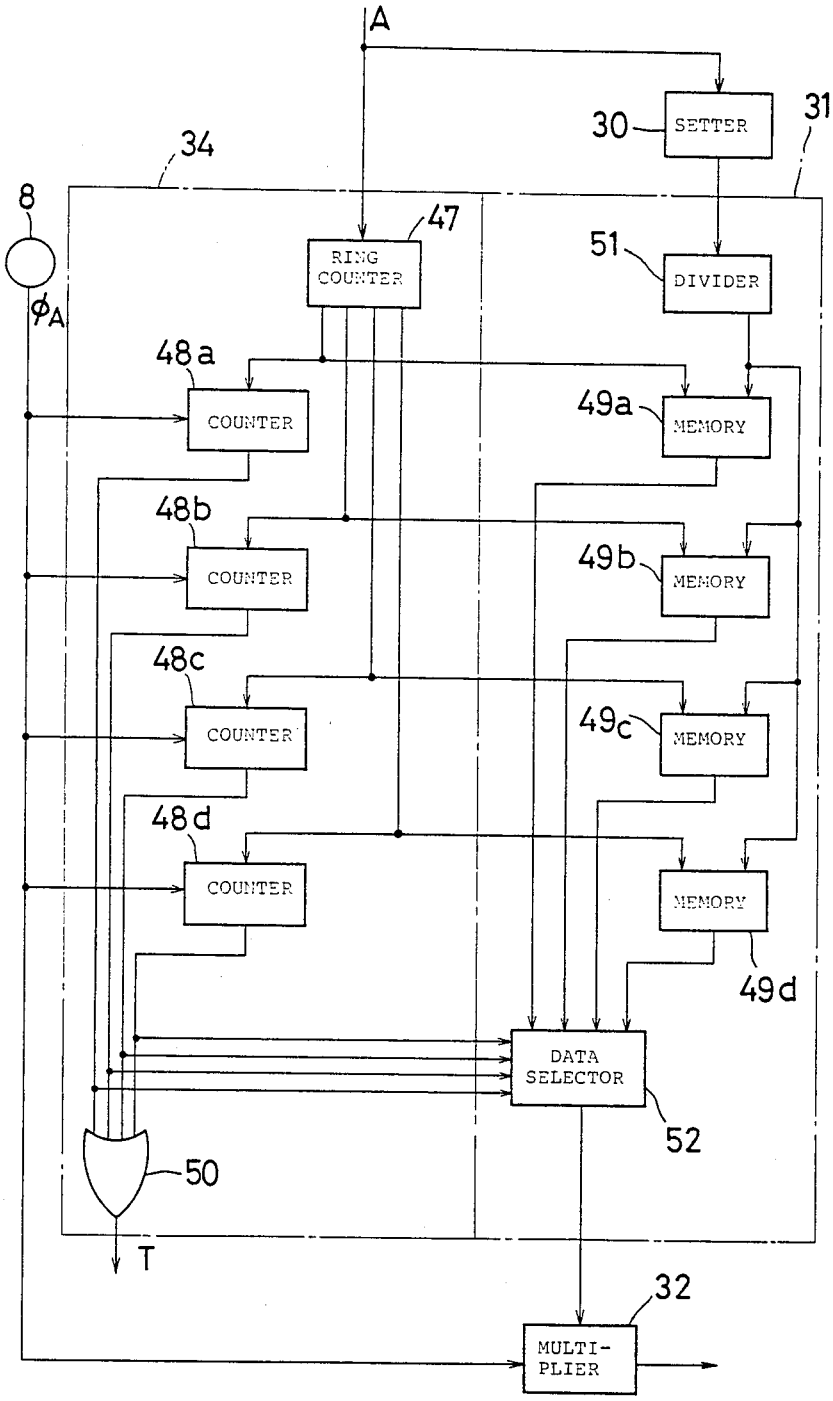
FIG. 4 is a block diagram of an example of the first counter and the divider.

Referring next to FIG. 4, the first counter 34 comprises a 4-bit ring counter 47 for counting the external signal A, four presettable counters 48*a* to 48*d*, and an OR circuit 50. The divider 31 comprises a dividing unit 51, four memories 49*a* to 49*d*, and a data selector 52. The counters and the memories with the same suffix make a pair, respectively. The ring counter 47 gives a signal for selecting one of the counters 48 and its respective memory 49 one after another each time it receives the external signal A. The selected counter starts the counting in response to the signal from the ring counter 47 and gives a signal to the OR circuit 50 when its count reaches the preset value X. The OR circuit 50 gives a timing signal T in response to the signal from one of the counters 48. The selected memory 49 registers the output of the dividing unit 51 which reads the values L and l from the setter 30 and performs a division l/L.

The data selector 52 outputs to the multiplier 32 the value stored in the memory 49 associated with that counter 48 from which a signal has been given, from when one counter has given a signal to when the next counter gives a signal. For example, it outputs the value stored in the memory 49*a* from the instant the counter 48*a* has given a signal to the instant the counter 48*b* gives a signal.

The number of the counters 48 and the memories 49 must be the same and may be predetermined according to the length of the blank and that of the sandwich belt conveyor 4 and thus the value X. The data selector 52 may be a memory circuit registering the value registered in the associated memory 49 in response to the signal from one of the counters 48.

The change in the setter 30 from one blank length L (that is the cutting length) to another is done at the same time as the issuance of the external signal A, e.g. in the following manner. The rotary cutter 3 gives a cutting complete signal, that is, the external signal. In response to the signal, a new cutting length is written in a setter on the speed controller for the rotary cutter 3. It is simultaneously it is set in the setter 30 of the control system according to the present invention.

Although the divider 31 shown in FIG. 4 includes a plurality of memories 49 and a data selector 52, if the web cutting length, that is, the blank length, does not change but is fixed, the memories and the data selector may be omitted. In this case, the divider 31 merely registers the value L (blank length) from the setter 30, divides the value l by the value L, and gives the result of division to the multiplier 32.

The divider 31 may be comprised of a plurality of blank length memories paired with the counters 48 and a dividing unit. Each time the count of the ring counter 47 changes, the associated blank length memory registers the blank length L which will be selected at the same time when the respective counter gives a signal, the dividing unit determining the coefficient $K_1(=l/L)$ and supplying it to the multiplier 32. Thus, the requirement for the divider is that it gives to the multiplier 32 a coefficient determined on basis of the length of the blank next to the blank that has just left the sandwich belt conveyor 4.

Next, it will be described how the blank presser is controlled if the blank length has changed.

Firstly, let us assume that the web is cut by the rotary cutter into blanks of a length $L_1$ and that $L_1$ is set in the setter 30 and that all the memories 49*a* to 49*d* register the coefficient $K_1=l/L_1$. When the last cutting into lengths $L_1$ is complete, the blank length set in the setter 30 changes from $L_1$ to $L_2$ (as mentioned above, $L_2$ has been preset) in response to the cutting complete signal for the last cutting into length $L_1$. Now, the dividing unit 51 outputs $K_2=l/L_2$. In response to the cutting complete signal, which is the external signal A, the ring counter 47 changes in its counts and gives a signal to select the pair of counter 48 and memory 49 corresponding to its new count. If the counter 48*a* and the memory 49*a* are selected, for example, the former starts the counting and the latter newly registers the coefficient $K_2=l/L_2$ from the dividing unit 51. When the count reaches the value X, the counter 48*a* gives a signal. In other words, the instant the last blank of length $L_1$ has left the sandwich belt conveyor 4, the counter 48*a* gives an output signal. The data selector 52 selects the memory 49*a*, which gives the coefficient $K_2=l/L_2$ to the multiplier. The rest is the same as when the blank length is fixed. The presser is controlled so that the brush presses the blank with the new length $L_2$ at a correct timing when it has just left the sandwich belt conveyor.

The circuit arrangement is such that the result of computation M $(=K\phi_A-\phi_B+E)$ from the counter 40 will be zero. If M is less than zero (<0), the error voltage Vc will be negative. Thus, the speed reference voltage Vo is $V_A+(-|Vc|)=V_A-|Vc|$. This means that it is lower than the reference voltage $V_A$ by the absolute value of the error voltage Vc. Therefore, the second motor 14 for the blank presser is decelerated so that the pulse signal $\phi_B$ will decrease. Thus, $M(=K\phi_A-\phi_B+E)$ will go back to zero.

If M becomes above zero (>0), Vc will be positive. Thus, Vo $(=V_A+Vc)$ is higher than the reference voltage $V_A$ by the error voltage Vc. The second motor 14 is accelerated so that the pulse signal $\phi_B$ will increase. Thus, M will go back to zero. In short, control is made so that the value M will be zero. This means that the second motor 14 for the blank presser is controlled so as to rotate at a predetermined ratio of revolutions with respect to the first motor 8 for the conveyor.

Summing up, what is done in this control system is to multiply the pulse signal $\phi_A$ proportional to the blank feed speed by a coefficient K $(=l/L)$, use the signal $K\phi_A$ as the reference speed of the second motor 14 for the blank presser 9, compare the actual speed of the sandwich belt conveyor 4 with the reference speed, and if there is any difference therebetween, accelerate or decelerate the second motor 14 to eliminate the difference. If there is any time difference between the occurrence of the detection signal S and that of the timing signal T (this means that the crank disc 13 is turning too quickly or too slowly for satisfactory pressing of the blank), too, the second motor 14 is accelerated or decelerated according to the amount of time difference. This compensation is performed by means of the position compensation circuit 35.

The sandwich belt conveyor 4 may be replaced with any other type of conveyor, e.g. a suction conveyor.

Although in the preferred embodiment a brush is used for the blank presser, it may be replaced with a roller or any other suitable member.

Although in the preferred embodiment the brush is adapted to rock, it may be adapted for an up-and-down or any other movement.

The control system for a blank presser according to the present invention may be used with any other type of conveyor than the conveyor 5 used in this invention, e.g. a vertically movable stacker on which the blanks are stacked one upon another.

For the control system for the blank presser in accordance with the present invention, a computer such as a microcomputer may be used with the use of software (program) for part or all of the control.

It will be understood from the foregoing that the present invention eliminates the need for watching and manual adjustment of position or movement of the blank presser because the blank presser is automatically controlled according to the change in the blank length and the blank feed speed to ensure that the blanks will be timely held down by the brush so that they will not jam up.

What are claimed are:

1. In a system having a conveyor and an upstream conveyor and a blank presser above said conveyor used to press each of the blanks fed one after another from said upstream conveyor and a control system for controlling the blank presser, the improvement comprising:

a setting means for setting a value (L) proportional to the length of the blanks fed from said upstream conveyor and a value (l) proportional to the distance by which said blank presser moves in one cycle of its operation;

a means for generating a signal ($\phi_A$) proportional to the speed at which said blanks are fed;

a means for generating a signal ($\phi_B$) proportional to the speed of said blank presser;

a counter which starts to count the signal ($\phi_A$) upon the arrival of a blank at said upstream conveyor and generates a timing signal (T) when its counter becomes equal to a value (X) representing the effective length of said upstream conveyor;

a divider for making a division (l/L) and generating a result of the division in response to the timing signal (T):

a multiplier for multiplying the result of the division (l/L) by the signal $\phi_A$;

a computing means for the performing a computation expressed by $l/L \times \phi_A - \mathbf{100}_B$;

a first converting means for generating a reference voltage ($V_A$) proportional to the result of said division;

a second converter for generating an error voltage ($V_C$) proportional to the result of said computation;

an operational amplifier for combining said reference voltage ($V_A$) and said error voltage ($C_C$); and a means for controlling a drive for said blank presser by use of the combined voltage so that the blanks will be held down by said blank presser at a correct timing.

2. A system as claimed in claim 1, further comprising a compensating means for generating a compensation value (E) proportional to the amount of a deviation, if there is any deviation from said correct timing, said computing means performing a computation expressed by $l/L \times \phi_A - \phi_B + E$ in response to the timing signal(T) to generate said error voltage.

* * * * *